US011267101B2

(12) United States Patent
Hursen

(10) Patent No.: US 11,267,101 B2
(45) Date of Patent: Mar. 8, 2022

(54) ABRASIVE MEDIA BLASTING METHOD AND APPARATUS

(71) Applicant: Thomas Francis Hursen, Glenshaw, PA (US)

(72) Inventor: Thomas Francis Hursen, Glenshaw, PA (US)

(73) Assignee: ARBORJET INC., Woburn, MA (US)

( * ) Notice: Subject to any disclaimer, the term of this patent is extended or adjusted under 35 U.S.C. 154(b) by 635 days.

(21) Appl. No.: 15/989,557

(22) Filed: May 25, 2018

(65) Prior Publication Data

US 2019/0134780 A1 May 9, 2019

Related U.S. Application Data

(60) Provisional application No. 62/511,752, filed on May 26, 2017.

(51) Int. Cl.
*B24C 5/04* (2006.01)
*B24C 1/10* (2006.01)

(52) U.S. Cl.
CPC . *B24C 5/04* (2013.01); *B24C 1/10* (2013.01)

(58) Field of Classification Search
CPC .... B24C 1/00; B24C 1/10; B24C 5/02; B24C 5/04; B24C 7/0046; B05B 7/1487
(Continued)

(56) References Cited

U.S. PATENT DOCUMENTS 2,666,279 A * 1/1954 Chalom ..... F04F 5/465 451/102

3,624,967 A * 12/1971 Kamper ..... B24C 3/065 451/2

(Continued)

OTHER PUBLICATIONS

R&D Journal of the South African Institution of Mechanical Engineering 2017, 33, 32-41, Investigation of Nozzle Contours in the CSIR Supersonic Wind Tunnel. (Published Jan. 2017). See pp. 33-36. (Year: 2017).*

(Continued)

*Primary Examiner* — Tyrone V Hall, Jr.
*Assistant Examiner* — Makena S Markman
(74) *Attorney, Agent, or Firm* — Blynn L. Shideler; Krisanne Shideler; BLK Law Group

(57) ABSTRACT

An improved media blasting system that separates the fluid velocity development, the introduction of media and the acceleration of media from each other. The preferred arrangement has a supersonic nozzle that produces supersonic velocity air discharged into a coupled acceleration chamber. No shot travels within the supersonic nozzle, so no wear of the supersonic nozzle interior occurs, thus making the nozzle shorter, of plain metal alloys, less expensive to manufacture and lasting indefinitely. The shot is separately introduced into the acceleration chamber thus avoiding it's otherwise limitation to the air mass flow rate in the air supply hose or pipe. Thus the average velocity used to transfer momentum to the shot is much higher than the lower average velocity currently available within other blasting nozzles, which occurs from throat to exit. Further, the nozzle design parameters are selected to match the higher maximum power output of a selected air compressor and are not constrained by nozzle wear factors requiring frequent replacement of the nozzle for reasons of nozzle wear.

18 Claims, 5 Drawing Sheets

(58) Field of Classification Search
USPC ..... 451/38, 40, 90, 102
See application file for complete search history.

(56) References Cited

U.S. PATENT DOCUMENTS

| | | | | | |
|---|---|---|---|---|---|
| 3,828,478 | A * | 8/1974 | Bemis | B24C 5/02 | 451/90 |
| 4,232,487 | A * | 11/1980 | Brown | B24C 5/02 | 451/88 |
| 5,283,985 | A * | 2/1994 | Browning | B24C 1/00 | 451/38 |
| 5,966,847 | A * | 10/1999 | Nathenson | B08B 5/02 | 137/874 |
| 5,975,996 | A | 11/1999 | Settles | | |
| 6,158,152 | A * | 12/2000 | Nathenson | B08B 5/02 | 239/532 |
| 6,293,857 | B1 | 9/2001 | Allard | | |
| 6,390,899 | B1 | 5/2002 | Loubeyre | | |
| 8,132,740 | B2 * | 3/2012 | Maev | B05B 12/085 | 239/135 |
| 8,162,239 | B2 * | 4/2012 | Hursen | B05B 1/3006 | 239/518 |
| 9,518,358 | B2 | 12/2016 | Pschorn et al. | | |
| 10,322,494 | B2 * | 6/2019 | Suzuki | B05B 14/45 | |
| 2002/0168466 | A1 * | 11/2002 | Tapphorn | B22F 3/001 | 427/180 |
| 2008/0156899 | A1 * | 7/2008 | McKew | B28C 5/026 | 239/142 |
| 2011/0250361 | A1 * | 10/2011 | Vijay | B05B 1/083 | 427/446 |
| 2016/0168721 | A1 * | 6/2016 | Nardi | B05B 7/1486 | 239/589 |
| 2020/0070309 | A1 * | 3/2020 | Kaya | B24C 1/003 | |

OTHER PUBLICATIONS

G.S. Settles, S. Garg, "A Scientific View of the Productivity of Abrasive Blasting Nozzles," Journal of Thermal Spray Technology, vol. 5( 1 ) March 199fv, pp. 35-41.

* cited by examiner

LONG VENTURI NOZZLE

PS NOZZLE

FIG. 3A
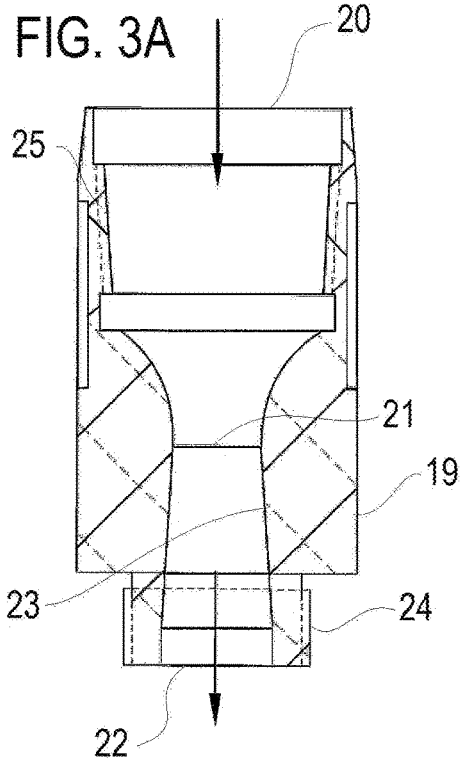
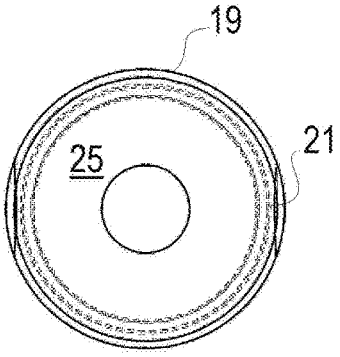
FIG. 3B
| PSIG | THROAT | EXIT | THROAT | EXIT | THROAT | EXIT | THROAT | EXIT | AVE | | |
|---|---|---|---|---|---|---|---|---|---|---|---|
| | Cd | Cd | Vt | Vx | Vt^2 | Vx^2 | Cd X Vt^2 | Cd X Vx^2 | Cd X V^2 | TH NOZZLE | CONCEPT |
| 100 | 0.850 | 1.1 | N/A | 1.685 | N/A | 2.839 | N/A | 3.123 | 3.123 | RATIO % | TH NOZZLE |
| 100 | 0.850 | 1.1 | 1.000 | 1.685 | 1.000 | 2.839 | 0.850 | 3.123 | 1.987 | 157% | P.S. NOZZLE |
| 100 | 0.850 | 1.1 | 1.000 | 1.434 | 1.000 | 2.057 | 0.850 | 2.263 | 1.556 | 201% | LONG VENTURE |
| | | | | | | | | | | | |
| | | | | | | | | | | | |
| | | | | | | | | | | | |
| | | | RELATIVE FORCE APPLIED (TFH/PS) | | | | | | | | |
| | | | | | | | | | | | |
FIG. 7

ABRASIVE MEDIA BLASTING METHOD AND APPARATUS

CROSS REFERENCE TO RELATED APPLICATIONS

The present application claims priority to provisional patent application Ser. No. 62/511,752 filed May 26, 2017 entitled "Abrasive Media Blasting Method and Apparatus" which is incorporated herein by reference.

BACKGROUND OF THE INVENTION

1. Field of the Invention

The present invention relates to abrasive media blasting and more particularly to shot and sand blasting devices and associated methods.

2. Background Information

Abrasive media blasting have been used extensively for many years and generally may be described as forcibly propelling a stream of abrasive material against a surface under high pressure to smooth a rough surface, roughen a smooth surface, shape a surface, or remove surface contaminants. A pressurized fluid, typically compressed air, or a centrifugal wheel is used to propel the blasting material (often called the media).

The first abrasive blasting process was patented by Benjamin Tilghman in 1870. Regarding abrasive media, the most abrasive are typically metal shot (known as shot blasting) and sand (known as sandblasting). Moderately abrasive media variants include glass beads. Plastic pellets, ground-up plastic stock, walnut shells and corncobs. A mild abrasive media include baking soda and some ice and dry ice media.

In the field of abrasive blast cleaning, constant-area or straight-bore nozzles were primarily used up until the 1950s. British patent No. 722,464 disclosed an abrasive blast cleaning nozzle with a converging-diverging configuration, sometimes referred to as the Mead nozzle.

Most current abrasive blast cleaning nozzles utilize what is called the Laval-type configuration, frequently (and some in the industry say mistakenly) known as "Venturi" nozzles (which term is intended to only refer to nozzles associated with low-speed fluids).

There are also what are known as "long-venturi" nozzles as described below which are commonly used in abrasive blast cleaning of all types, especially including steel structures, such as bridges and the like, to remove paint and corrosion.

Typical methods pick up the media by induction of the media into low to moderate velocity air (or other carrier). The air carries the media to the inlet of a nozzle of various styles. The nozzle accelerates the air though a restricted throat plus the subsequent expansion region of the nozzle until the media exits the nozzle. In practice, these tend to be generally referred to long or short nozzles. The longer nozzles tend to be elongated various amounts beyond the throat while the shorter nozzles have much less length beyond the throat. For the same air mass flow rates, the best performing nozzles are usually referred to as long venturi nozzles, which are also called long nozzles. As the media passes through the nozzle throat and then the remainder of the nozzle, the media velocity is increased by the action of the higher velocity air upon the slower media. This is done to increase the effectiveness of the media to perform it's various purposes. It is generally recognized that higher media velocity produces greater blasting effectiveness for those applications that require greater effectiveness and/or reduction in application time.

A significant problem associated with the long-venturi nozzle is that it is remarkably inefficient with regard to the transfer of energy from the compressed airstream flowing through the nozzle to the abrasive particles entrained therein. This energy transfer efficiency is typically only on the order of about 10%. See, for example, "A Scientific View of the Productivity of the Abrasive Blasting Nozzles," Journal of Protective coatings and Linings, April 1995, pages 28-41 and 101-102. In some common commercial nozzle designs, the exit velocity of the air is more than 4.5 times that of the media and as kinetic energy is proportional to the square of velocity, the kinetic energy of the media particles exiting the nozzle is about 5% that of the air stream at equal air and media mass flow rates. Thus, 95% of the kinetic energy of the air stream is being lost in such nozzle designs.

For further background on blast nozzle configurations see U.S. Pat. Nos. 6,293,857; 6,390,899; and 9,518,358 which are incorporated herein by reference.

An abrasive blast cleaning nozzle design is identified in Penn State University U.S. Pat. No. 5,975,996, which is incorporated herein by reference, and which attempts to address some of these concerns. This discloses a nozzle, also herein called a PS Nozzle or Penn State Nozzle, for an abrasive blast cleaning apparatus consisting of a short, relatively rapidly converging inlet section, a constant-area throat, a rapidly diverging first diverging section, and a long second diverging section that diverges less rapidly than the first diverging section. The inlet section quickly accelerates the abrasive particles after entering the PS nozzle, while the first diverging section rapidly brings the relative velocity of the air stream and the abrasive particles to about Mach 1.4. The second diverging section helps to maintain the relative Mach number while the abrasive particles continue to accelerate. This makes abrasive blast cleaning more efficient, particularly because the kinetic energy of the abrasive particles emerging from the nozzle is significantly increased. The PS nozzle is similar to a similar long venturi nozzle geometry and have the same entrance diameter and the same throat diameter, but the PS nozzle has a different exit area, and substantial additional length after the throat. The increase in length was determined by use of Newton's equation F=(m) (A), converted to F=(Cd)(p) (Vrelt2 /2), wherein the developers of the PS nozzle surmised that the prior venturi nozzle in this field was of the general form of a DeLaval (supersonic) nozzle, and, that this relationship could be applied to determine a longer length for the expanding PS nozzle portion that would meet specific (if somewhat arbitrary) nozzle design requirements. This lengthening would increase the velocity of the media exiting the PS nozzle by a calculated 35% over the media exit velocity of the comparable long venturi nozzle. The '966 patent also describes other small adjustments to the PS nozzle throat geometry, but not the throat area.

The media blast PS nozzle design of the '966 patent is a step forward in the design of such nozzles, but, it failed to solve at least three of the historic difficulties of these and other shot, sand or hard media blasting nozzles. These are: (1) nozzle wear at the throat, (2) continuously wear through the nozzle expansion region and (3) wear at the exit diameter, all caused by the media passing through the nozzle. Since the internal air velocity within the nozzle expansion region is what increases the speed of the media particles, and this improves application effectiveness, this degradation of the nozzle function begins immediately with the first nozzle use and continues with each subsequent use.

Further as each internal diameter between the throat and the nozzle exit is initially different from every other internal diameter for appropriate velocity development, even uniform internal nozzle wear, which will not occur, results in disproportional wear from a design and performance perspective. Nozzle wear will not be uniform since it is a function of initial and subsequent velocity plus initial and subsequent diameter at every location along the nozzle axis between the throat and the nozzle exit.

These issues are well known in the industry, and lead to material composition, hardness and cost trade-offs in nozzle design and frequency of nozzle replacement. No material lasts forever in this type of application especially when media materials such as steel shot and sand are employed.

Further, blasting nozzles are generally rated by their throat diameter: (#5, 5/16 Inch diameter), (#7, 7/16 Inch diameter), etc. which is arbitrary and not with any appropriate or apparent connection to any specific air compressor rating. This produces serious mismatches between available compressor power and nozzle configuration resulting in continuous wasted power during almost every blasting nozzle use, regardless of type.

The remains a need for an effective abrasive media blasting nozzle that minimizes wear in an effective and cost efficient manner.

SUMMARY OF THE INVENTION

The advantages of the present invention are achieved with an abrasive media blasting apparatus including a supersonic nozzle having a nozzle entrance configured to be coupled to a pressurized fluid source, a supersonic nozzle throat, and a nozzle exit; and an acceleration chamber coupled to the nozzle exit and having a uniform internal cross sectional area along an axial length of the acceleration chamber and the acceleration chamber having an abrasive media inlet in the acceleration chamber adjacent the nozzle exit and configured to be coupled to a source of abrasive media One embodiment of the present invention provides a shot media blasting apparatus including a supersonic nozzle having a nozzle entrance configured to be coupled to a pressurized air source, a supersonic nozzle throat, and a nozzle exit; and an acceleration chamber coupled to the nozzle exit and having a uniform internal cross sectional area along an axial length of the acceleration chamber, wherein the uniform internal cross sectional area of the acceleration chamber matches a cross sectional area of the nozzle exit, and wherein the acceleration chamber having a shot inlet in the acceleration chamber adjacent the nozzle exit and configured to be coupled to a source of shot.

One aspect of the present invention provides a method of abrasive media blasting comprising the steps of: Introducing pressurized fluid into the nozzle entrance of a supersonic nozzle; Accelerating the fluid through the supersonic nozzle to a supersonic nozzle throat; Passing the fluid from the supersonic throat to an exit of the supersonic nozzle; Introducing abrasive media into the flow of fluid downstream of the nozzle exit in an acceleration chamber coupled to the nozzle exit via an abrasive media inlet; Accelerating the media within the acceleration chamber along a uniform internal cross sectional area along an axial length of the acceleration chamber.

This new invention utilizes a supersonic nozzle to produce the high velocity that is beneficial to the blasting application but avoids the complication and disadvantages of media wear on the expensive nozzle material which is at the heart of the present technology. This is because, the shot or other media does not travel though the supersonic nozzle, but only through a uniform area/diameter acceleration chamber, into which the supersonic nozzle discharges it's high velocity air. Since there is no media, only air, traveling through this nozzle, and it does not wear and can be much shorter and manufactured from less expensive material. Thus the only function of the supersonic nozzle is to convert compressed air to supersonic air, as efficiently as possible. This nozzle is much shorter than current abrasive media blasting nozzles, because the media acceleration function is decoupled from the internal structure of the nozzle. Further, the acceleration chamber is substantially more effective in increasing media acceleration since only the highest velocity available air from the nozzle is applied to media acceleration in the acceleration chamber. Further because the nozzle is decoupled from internal media acceleration, both the nozzle and the acceleration chamber can be configured independently to maximize the specific function of each, and which reduces the size of each to an extent that the total length of the two functions combined is substantially smaller than the traditional long venturi nozzle and the much longer nozzle designed in accordance with the teachings of the '966 patent.

Only the maximum velocity output of the supersonic nozzle is used to accelerate media, therefore the performance of this configuration is also substantially improved over conventional prior art nozzle designs. Thus the industry will get more performance for less investment. This design also frees the nozzle and thus the complete blasting system to be configured to correspond to the peak power output of the specific fluid source that supplies the nozzle.

The high velocity output of the nozzle is closely coupled to an acceleration chamber into which the media is independently inserted. This acceleration chamber is of the same or similar diameter and or shape as the outlet diameter of the nozzle so that the high nozzle exit velocity is not diminished by entry into this acceleration chamber. It is only diminished to the extent the high velocity air transfers energy to the media, which increases media velocity. There is a small loss to air friction or drag in the chamber, but because the chamber is much shorter than current and earlier technologies, and does not have any restrictions, it is a minor loss.

The length of the acceleration chamber can be selected to optimize (maximize) the energy transfer from the much higher air velocity to the media, or to reduce the exit velocity of the media by using a shorter chamber for more sensitive applications. This is determined by either calculation or test, and this simple chamber will wear but is less expensive than current abrasive media blasting nozzles, and is far less expensive than the more expensive long nozzles presently used. Since the maximum exit velocity of the supersonic nozzle is used to accelerate the media, the length of this energy transfer element is minimized, with obvious advantages in cost and wear.

Furthermore, based upon the nature of air conveyance in uniform area conduits, the wear is going to be very small, and restricted to the region of the chamber in the vicinity of the media introduction.

In this system there are alternative mechanisms of introducing abrasive media such as shot. The simplest is gravity insertion from a few feet above the nozzle through a small diameter hose. The media hose diameter is much smaller than the usual combination abrasive media/air supply current or older nozzles require, because air propulsion is not required either to or within the supersonic nozzle. Simple introduction of media, such as namely metal shot, under the combination of entry at the highest velocity region of the primary air flow (Bernoulli affect) plus gravity is sufficient for many hand held applications. Introducing abrasive media in this way through a shot tube open to the atmosphere also introduces a small quantity of atmospheric air. If this is to be avoided for larger applications, a closed container can be used or the cross section of the acceleration chamber can be adjusted along it's axis to suit. A valve in the shot tube can be either manual or remotely operated and the valve is provided to avoid media accumulation in the acceleration chamber when no air is flowing.

This system includes a replaceable wear tip at the exit of the acceleration chamber. This will be the location of greatest wear as the result of the proximity of the system's higher velocity abrasive media exit to the surface being blasted. This abrasive media, particularly with metal shot, rebound will be very energetic. Further an adjustable and flexible shield protects the operator.

BRIEF DESCRIPTION OF THE DRAWINGS

FIGS. 3A and B are a schematic side section and top plan views, respectively, of a supersonic nozzle forming one component of an apparatus for use in abrasive media blasting in accordance with one embodiment of the present invention;

FIG. 7 is a performance chart of the three comparative nozzle designs which details the comparative numerical calculations of the force acting on individual shot being accelerated within each configuration.

DETAILED DESCRIPTION OF THE PREFERRED EMBODIMENT

Figure 1:
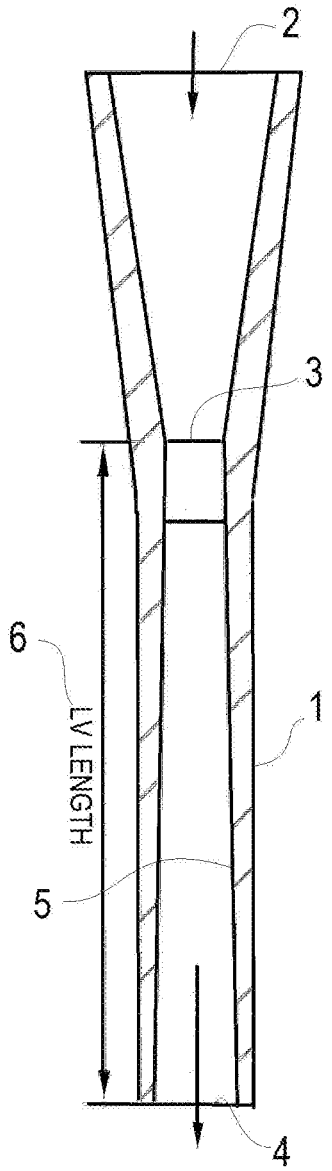
FIG. 1 PRIOR ART
FIG. 1 is a schematic side section view of a prior art Long Venturi nozzle.
Figure 2:
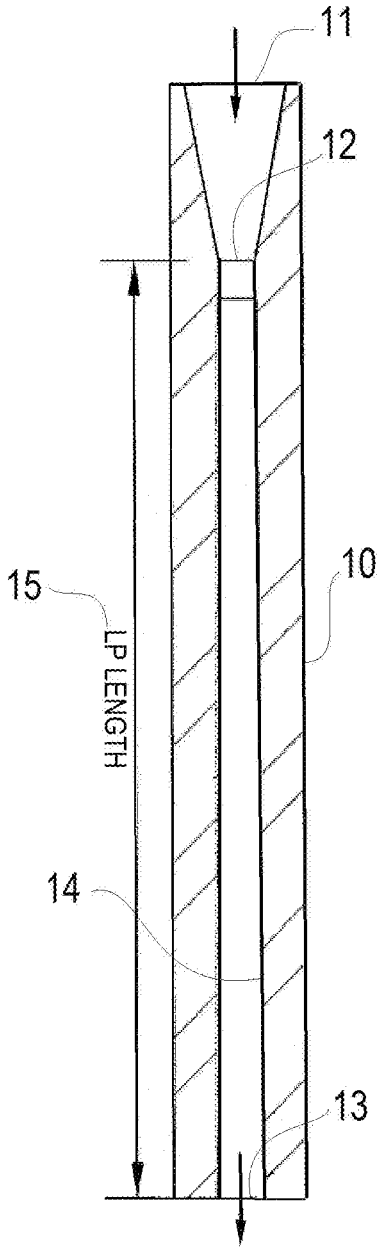
FIG. 2 PRIOR ART
FIG. 2 is a schematic side section view of a prior art P.S. Nozzle.

Referencing the figures, FIG. 1 is a schematic side section view of a prior art Long Venturi nozzle 1 discussed above, and used herein for comparison. A commercial long venturi nozzle 1 viewed in cross section is shown and has a venturi nozzle entrance 2, a venturi nozzle throat 3 to increase air velocity and a venturi nozzle exit 4, usually larger than the throat, a venturi nozzle expansion 5, and an LV length 6, FIG. 2 is a schematic side section view of a prior art P.S. Nozzle 10 discussed above and used herein for comparison. A P.S. nozzle 10 has a P.S. nozzle entrance 11, a P.S. nozzle throat 12, a P.S. nozzle exit 13, a P.S. nozzle expansion 14 and an LP length 15.

FIGS. 3A and B are a schematic side section and top plan views, respectively, of a supersonic nozzle 19 forming one component of an apparatus for use in abrasive media blasting in accordance with one embodiment of the present invention. The supersonic nozzle 19 has a supersonic nozzle entrance 20, a supersonic nozzle throat 21, a supersonic nozzle exit 22, a supersonic nozzle expansion 23, a supersonic nozzle exit connection 24 and a supersonic entrance connection 25.

Figure 4A:
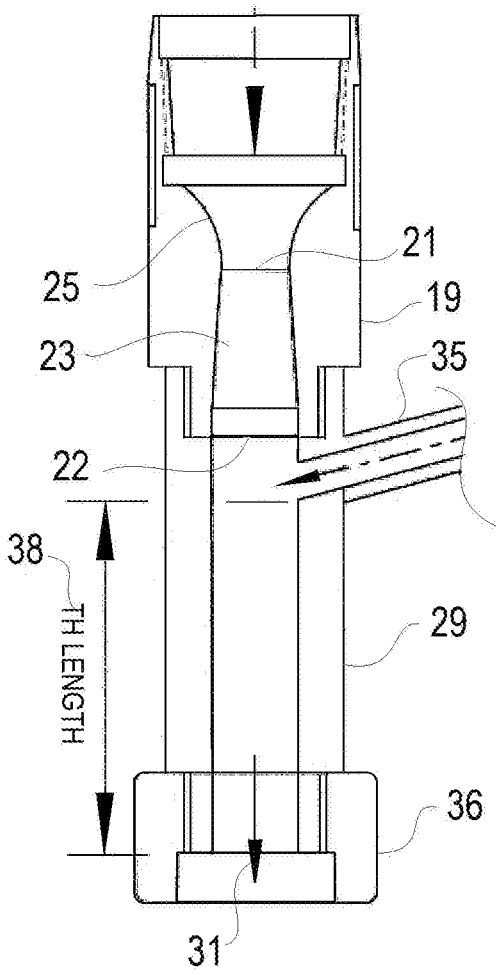
FIG. 4A is a schematic side section views of the supersonic nozzle of FIGS. 3A and B with an acceleration chamber and wear tip for abrasive media blasting forming components of an apparatus for use in abrasive media blasting in accordance with one embodiment of the present invention.
Figure 4B:
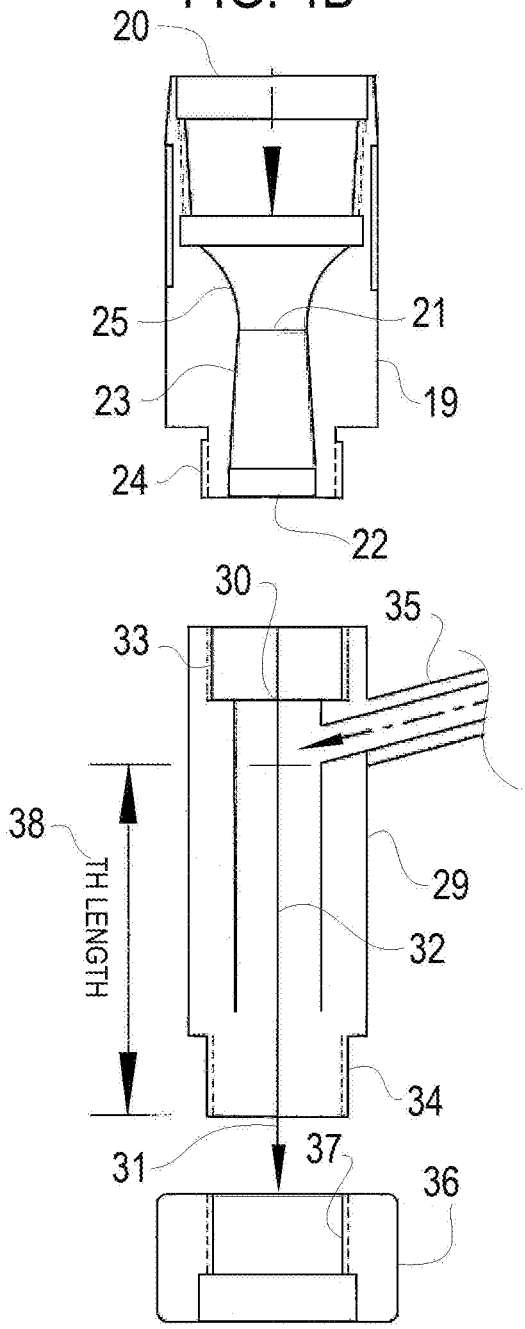
FIG. 4B is an exploded schematic side section views of the supersonic nozzle and acceleration chamber and wear tip in the assembled view of FIG. 4A.

FIG. 4A is a schematic side section views of the supersonic nozzle of FIGS. 3A and B with an acceleration chamber and wear tip for abrasive media blasting forming components of an apparatus for use in abrasive media blasting in accordance with one embodiment of the present invention. FIG. 4B is an exploded schematic side section views of the supersonic nozzle and acceleration chamber and wear tip in the assembled view of FIG. 4A. The apparatus for abrasive media blasting includes a supersonic nozzle 19, an acceleration chamber 29 and a wear tip 36. FIG. 4B is an exploded view of the same hardware for clarity and includes a supersonic nozzle 19, an acceleration chamber 29, an acceleration chamber entrance 30, an acceleration chamber exit 31, an acceleration chamber interior 32, an acceleration chamber inlet connection 33, an acceleration chamber outlet connection 34, a shot tube 35, a wear tip 36, a wear tip connection 37 and a TH length 38.

Figure 5:
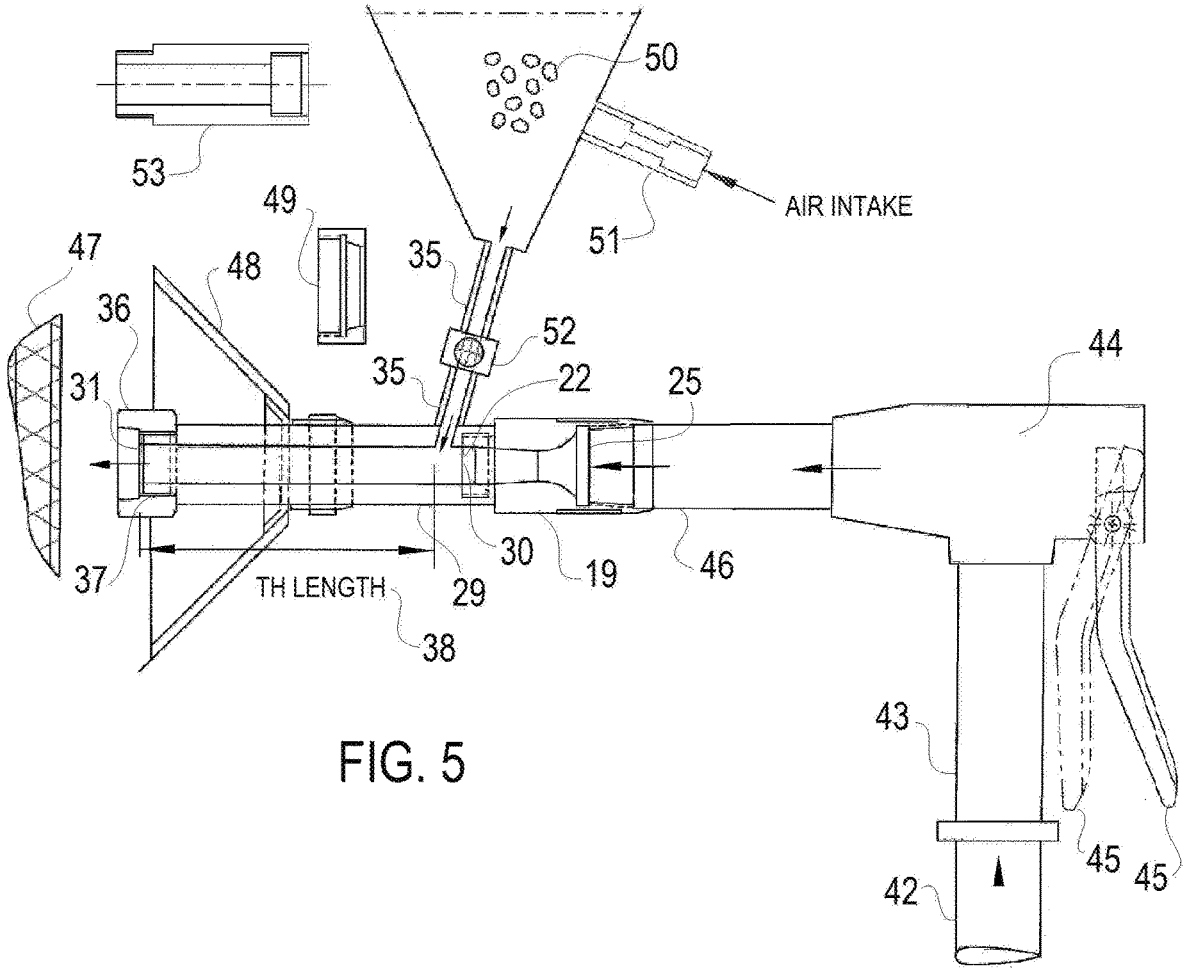
FIG. 5 is a schematic side section view of a an apparatus for use in abrasive media blasting in accordance with one embodiment of the present invention.

FIG. 5 is a schematic side section view of a supersonic abrasive media, such as particularly metal shot, blast system or apparatus in accordance with one aspect of the present invention. With the addition of an air compressor as shown in FIG. 5 the apparatus becomes a complete supersonic blasting system. Compressed air enters into flexible air hose 42, then into a handle 43, through valve 44, under the control of a dead man trigger 45. When the air control valve 44 is opened, air passes through a barrel 46 to the entrance 20 of a supersonic nozzle 19, then through the supersonic nozzle exit 22 at supersonic speed, into the acceleration chamber entrance 30 of the acceleration chamber 29. Abrasive media such as shot 50 passing through the media tube 35, joins the supersonic air stream within the acceleration chamber 29 and is accelerated towards the target 47. A wear tip 36 protects the acceleration chamber 23 from wearing impact from the shot rebounding from the target. An adjustable protection shield 26 protects the operator from the same rebounding shot. The shot 50 is supplied from an open or closed shot container 51, through a shot tube 35, under the control of a shot valve 52.

An optional or alternative acceleration chamber extension 53, not installed, is available to be added to increase shot 50 exit velocity. An adjustable protection shield 48 protects the operator from blow back. A locking nut 49 for the shield 48 is shown in FIG. 5, out of position, above the adjustable protection shield 48. In position the nut 49 secures onto the shield to secure the shield in the desired location, as generally known in the art.

FIG. 5 illustrates the preferred embodiment of the present invention. A compressor, not shown, powers the system by supplying pressurized air through a flexible air hose 42 through the handle 43, connected to the air control valve 44, controlled by the operator through a dead man trigger 45. Pressurized air travels through a barrel 46, to the supersonic nozzle 19. The air flow is constricted by the supersonic nozzle throat 21 to sonic velocity, and then to supersonic velocity by the correct supersonic nozzle expansion 23 until it reaches the supersonic nozzle exit 22.

Figure 6:
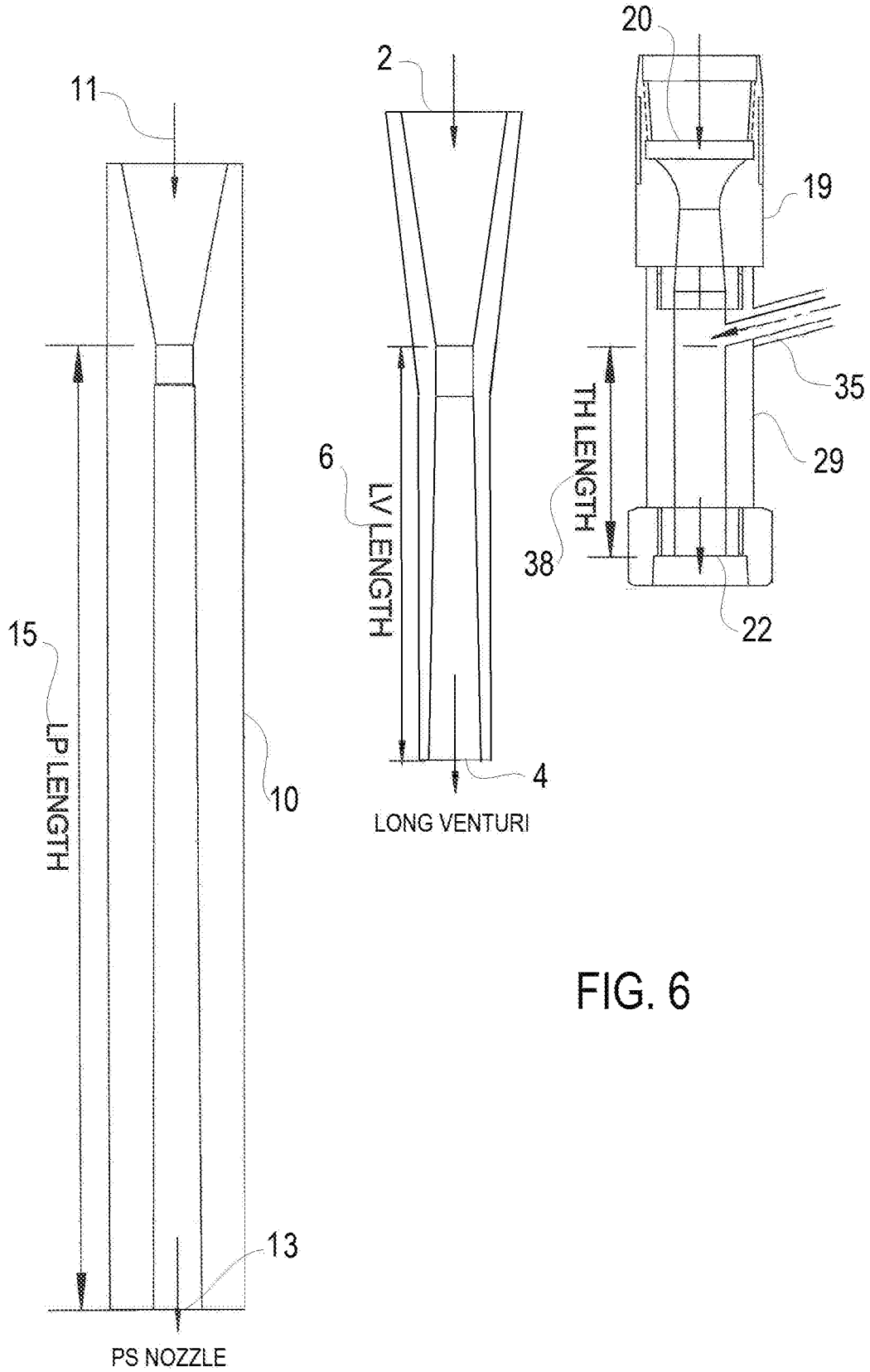
FIG. 6 is a schematic side section views of acceleration tube lengths for comparison which illustrates the comparative hardware acceleration lengths LV length, (venturi), LP length (P.S. nozzle) and TH length (acceleration chamber) as well as the total length of each concept, all at the same scale.

An acceleration chamber 29 is closely connected to the supersonic nozzle exit 22, and has a uniform internal cross sectional area similar to or the same as the supersonic nozzle exit 22. The abrasive media, in particular metal shot 50, enters the acceleration chamber 29, close coupled to the supersonic nozzle exit 22. The shot 50 is acted upon by the maximum supersonic velocity produced by the supersonic nozzle 19. The air velocity within the acceleration chamber 29 declines essentially to the extent of the energy transfer from the air to the shot 50 within the acceleration chamber 29. Because of the much higher air velocity in the acceleration chamber 29, the TH LENGTH 38 of the new configuration is shorter than the LV LENGTH 6 of the long venturi nozzle 1 and much shorter than the LP LENGTH 15 of the P.S nozzle 10 as shown in the comparison of FIG. 6. In addition to being shorter than prior art designs, it is much more productive because of the higher average air velocity in the acceleration chamber 29.

The constant cross section area of the acceleration chamber 29 allows wear to be greatly reduced over prior art nozzle designs. Further because this is a simple element to machine, and being significantly shorter than either of the two nozzle references currently available to accelerate shot, it is much less expensive to manufacture. Further as the accelerating chamber interior 32 does exhibit a small critical throat, or a critical exit to determine air velocity during the energy transfer process, the lesser wear of its internal shape has little effect upon air velocity and on energy transfer to the shot 50. Neither the supersonic nozzle 19 nor the acceleration chamber 29 will require expensive exotic material for construction.

The acceleration chamber 29, includes a wear tip 36 since the much higher velocity of shot or sand or the like will bounce back energetically from the target 47 towards the acceleration chamber 29 and wear the exterior of the acceleration chamber quickly 29 if not protected. Operator protection is achieved by an adjustable protection shield 48.

The shot container 51 is elevated above the acceleration chamber 29, since gravity is usually enough to provide the necessary mass flow in combination with the lowered local pressure available from the supersonic velocity air within the acceleration chamber interior 32. As the shot has a separate entrance, independent of the air flow, it's mass flow can be separately adjusted, if desired or appropriate. Thus it is not limited by the inlet air mass flow rate and velocity, which is the case for the two reference prior art nozzles discussed above. The shot container 51 is connected to the acceleration chamber 29 by a shot tube 35, the shot controlled by a shot valve 52.

FIG. 6 is a schematic side section views of Acceleration tube lengths of the present invention and the PS Nozzle and the long venture nozzle of the prior art for comparison which illustrates the comparative hardware acceleration lengths LV length, (venturi), LP length (P.S. nozzle) and TH length (acceleration chamber) as well as the total length of each concept, all at the same scale.

FIG. 7 is a performance chart of the three comparative nozzle designs which details the comparative numerical calculations of the force acting on individual shot being accelerated within each configuration. The percentages at the right indicate the relative minimum force increase of the present invention when compared to the P.S. nozzle (57%) and the venturi nozzle (101%).

The throat of each of the three nozzles used for comparison is of the same diameter. (7/16 Inch). This is a commercially available size. It is an arbitrary diameter that is commonly referred to as a #7 nozzle. A typical commercial compressor of sufficient air pressure and volume (CFM) to power this nozzle at sonic velocity at the throat is rated at 150 PSIG and 375 CFM. It is noteworthy that this nozzle size occurred without reference to this specific compressor size, as is the usual commercial practice, and as a consequence, this compressor has more power available in its output air than this nozzle will efficiently use. This further implies the designated nozzle input conditions have not been selected at the peak power of the compressor output. Thus, a further increase in the capability (power & efficiency) of the new nozzle design can be achieved by designing the nozzle to use the maximum power inlet conditions available from the compressor.

Since the three nozzles described in this comparison have the same upstream inlet 100 psig, as well as the same throat diameter, they have the same theoretical air mass flow rate. The (TH) supersonic nozzle 19 and the P.S nozzle 10 have the same exit diameter. The long venturi nozzle 1 exit is larger than both the supersonic nozzle 19 and the P.S. nozzle 10. This larger diameter lowers the air exit velocity and the average air velocity within the venturi nozzle expansion 5. Regarding FIG. 7. This table details the method used to calculate the average force imposed on an individual particle while it is being accelerated. This relationship and the necessary charts are in the reference patent. The percentages at the right in the table indicate the relative minimum force enhancement of the present invention on each single shot particle when compared to the P.S. nozzle 10 (57%) and the long venturi nozzle (101%). This mode of comparison was employed since it was not dependent upon the integration of an appropriate differential equation with limits for each configuration and associated conditions, which would be more difficult to verify.

The general manner of calculating the relative force acting on an individual shot is as follows. The force acting on any individual shot F=(Cd)×(Vrel)"2/2 as in U.S. Pat. No. 5,975,996

Cd is a coefficient related to the shot geometry I $$(V\text{rel})''2=(V\text{air}-V\text{shot})''2$$

Vair is the velocity of the air acting to accelerate the shot,

Vshot is the velocity of the shot at any time,

Vrel is the difference in velocity that acts on the shot.

The average F for each design is calculated This force is then compared for each of the three configurations. FIG. 7 shows the result of these calculations and illustrates the significant superiority of this concept over both the long venturi nozzle 1 and the P.S. nozzle 10.

The present invention has been described with reference to specific details of particular embodiments thereof. It is not intended that such details be regarded as limitations upon the scope of the invention. It will be apparent that various modifications can be made without departing from the spirit and scope of the present invention. The precise scope of the invention is to be defined by the appended claims and equivalents thereto.

What is claimed is:

1. An abrasive media blasting apparatus comprising:

A supersonic nozzle having a nozzle entrance configured to be coupled to a pressurized air source for supplying non-combusted air to the nozzle entrance, a supersonic nozzle throat, a converging portion extending from the nozzle entrance to the nozzle throat and diverging portion extending from the nozzle throat to a nozzle exit, wherein the nozzle further includes a supersonic nozzle exit connection surrounding the supersonic nozzle exit; and An acceleration chamber coupled to the nozzle exit and having a uniform internal cross sectional area along an axial length of the acceleration chamber from an acceleration chamber entrance to an acceleration chamber exit, and the acceleration chamber having an abrasive media inlet in the acceleration chamber adjacent the nozzle exit and at an angle relative to perpendicular to a longitudinal axis of the acceleration chamber extending from the acceleration chamber entrance to the acceleration chamber exit, wherein the abrasive media inlet is configured to be coupled to a source of abrasive media, wherein the acceleration chamber includes an acceleration chamber inlet connection surrounding the acceleration chamber entrance, and wherein the acceleration chamber inlet connection is attached to the supersonic nozzle exit connection, and wherein the uniform internal cross sectional area of the acceleration chamber matches a cross sectional area of the nozzle exit.

2. The abrasive media blasting apparatus according to claim 1, further including a wear tip coupled to a distal end of the acceleration chamber.

3. The abrasive media blasting apparatus according to claim 2, wherein the acceleration chamber is threaded to the nozzle exit.

4. The abrasive media blasting apparatus according to claim 3, further including an abrasive media container and a tube extending from the abrasive media container to the abrasive media inlet in the acceleration chamber.

5. The abrasive media blasting apparatus according to claim 4, further including a valve tube extending from the abrasive media container to the abrasive media inlet in the acceleration chamber.

6. The abrasive media blasting apparatus according to claim 5, wherein the media container is elevated above the acceleration chamber forming a gravity feed.

7. The abrasive media blasting apparatus according to claim 6 further including an adjustable protection shield coupled to an exterior of the acceleration chamber and configured to protect the operator from blow back.

8. The abrasive media blasting apparatus according to claim 6 further including a flexible hose configured to be coupled to the source of pressurized air and extending through a handle and connected to a control valve controlled by the operator with a barrel coupled to the valve and to the nozzle entrance.

9. A method of abrasive media blasting comprising the steps of:

Providing a supersonic nozzle having a nozzle entrance, a supersonic nozzle throat, a converging portion extending from the nozzle entrance to the nozzle throat and diverging portion extending from the nozzle throat to a nozzle exit, wherein the nozzle further includes a supersonic nozzle exit connection surrounding the supersonic nozzle exit;

Coupling an acceleration chamber to the nozzle exit and wherein the acceleration chamber has a uniform internal cross sectional area along an axial length of the acceleration chamber from an acceleration chamber entrance to an acceleration chamber exit, and the acceleration chamber has an abrasive media inlet in the acceleration chamber adjacent the nozzle exit at an angle relative to perpendicular to a longitudinal axis of the acceleration chamber extending from the acceleration chamber entrance to the acceleration chamber exit, wherein the acceleration chamber includes an acceleration chamber inlet connection surrounding the acceleration chamber entrance, wherein the uniform internal cross sectional area of the acceleration chamber matches a cross sectional area of the nozzle exit, and wherein the acceleration chamber inlet connection is attached to the supersonic nozzle exit connection for the coupling of the acceleration chamber to the nozzle exit;

Coupling the nozzle entrance to a source of pressurized air;

Coupling the abrasive media inlet to a source of abrasive media;

Introducing non-combusted pressurized air into a nozzle entrance of a supersonic nozzle;

Accelerating the pressurized air through the supersonic nozzle to a supersonic nozzle throat;

Passing the air from the supersonic throat to an exit of the supersonic nozzle;

Introducing abrasive media into the flow of air downstream of the nozzle exit in the acceleration chamber via the abrasive media inlet;

Accelerating the abrasive media within the acceleration chamber in the uniform internal cross sectional area along an axial length of the acceleration chamber.

10. The method of abrasive media blasting according to claim 9, further including the step of providing a replaceable a wear tip coupled to a distal end of the acceleration chamber.

11. The method of abrasive media blasting according to claim 10, wherein the acceleration chamber is threaded to the nozzle exit.

12. The method of abrasive media blasting according to claim 11, further including the step of providing an abrasive media container holding the source of abrasive media and a tube extending from the abrasive media container to the abrasive media inlet in the acceleration chamber.

13. The method of abrasive media blasting according to claim 12, further including the step of providing a valve tube extending from the abrasive media container to the abrasive media inlet in the acceleration chamber.

14. The method of abrasive media blasting apparatus according to claim 13, wherein the media container is elevated above the acceleration chamber forming a gravity feed.

15. The method of abrasive media blasting according to claim 14 further including the step of providing an adjustable protection shield coupled to an exterior of the acceleration chamber and configured to protect the operator from blow back.

16. The method of abrasive media blasting according to claim 15 further including a flexible air hose configured to be coupled to a source of pressurized air and extending through a handle and connected to an air control valve controlled by the operator with a barrel coupled to the valve and to the nozzle entrance.

17. The method of abrasive media blasting according to claim 16 wherein the media is shot.

18. A shot media blasting apparatus comprising:

A supersonic nozzle having a nozzle entrance configured to be coupled to a pressurized air source for supplying non-combusted air to the nozzle entrance, a supersonic nozzle throat, a converging portion extending from the nozzle entrance to the nozzle throat and diverging portion extending from the nozzle throat to a nozzle exit, wherein the nozzle further includes a supersonic nozzle exit connection surrounding the supersonic nozzle exit; and An acceleration chamber coupled to the nozzle exit and having a uniform internal cross sectional area along an axial length of the acceleration chamber from an acceleration chamber entrance to an acceleration chamber exit, wherein the uniform internal cross sectional area of the acceleration chamber matches a cross sectional area of the nozzle exit, and wherein the acceleration chamber having a shot inlet in the acceleration chamber adjacent the nozzle exit and at an angle relative to perpendicular to a longitudinal axis of the acceleration chamber from the acceleration chamber entrance to the acceleration chamber exit, wherein the shot inlet is configured to be coupled to a source of shot, wherein the acceleration chamber includes an acceleration chamber inlet connection surrounding the acceleration chamber entrance, and wherein the acceleration chamber inlet connection is attached to the supersonic nozzle exit connection.

* * * * *